United States Patent [19]

Baggott

[11] 3,963,125

[45] June 15, 1976

[54] RACK FOR STORING TRAYS OR THE LIKE

[75] Inventor: George T. Baggott, Cleveland, Ohio

[73] Assignee: Crescent Metal Products, Inc., Cleveland, Ohio

[22] Filed: Jan. 23, 1975

[21] Appl. No.: 543,279

[52] U.S. Cl. ..... 211/126; 211/71; 108/109; 780/79.3

[51] Int. Cl.[2] ..... A47F 3/14; A47F 47/00

[58] Field of Search ..... 211/71, 85, 126, 134, 211/133, 162; 220/4 F, 80; 312/350; 280/79, 79.2, 79.3, 47.19, 47.35; 108/106–110

[56] References Cited

UNITED STATES PATENTS

| | | | |
|---|---|---|---|
| 291,513 | 1/1884 | Hoffman | 108/107 |
| 2,423,955 | 7/1947 | Widener | 220/4 F X |
| 3,124,402 | 3/1964 | Rhoads | 211/162 X |
| 3,199,683 | 8/1965 | Graswich | 211/71 |
| 3,570,682 | 3/1971 | Elliott | 211/126 |
| 3,655,063 | 4/1972 | Landry | 211/71 |

FOREIGN PATENTS OR APPLICATIONS

| | | | |
|---|---|---|---|
| 814,856 | 6/1969 | Canada | 280/79.3 |

*Primary Examiner*—James T. McCall
*Assistant Examiner*—Terrell P. Lewis
*Attorney, Agent, or Firm*—Bosworth, Sessions & McCoy

[57] ABSTRACT

Material on trays or in pans can be stored or transported on a rack which is open at the front and which has horizontal ledges on its sides on which the trays or pans are supported. Construction of the rack can be made easier and more economical by providing slots on the vertical posts of the rack into which horizontal support members comprising the ledges are inserted. Only the uppermost and lowermost support members need be secured in the slots to provide a solid rack frame. Alternative designs of the rack include a multiple unit rack, dual ledges to restrain the tray from tipping when it is less than halfway in the rack, enclosure of the rack to form a cabinet, removable side panels on the rack, and a rack for storing trays vertically.

6 Claims, 13 Drawing Figures

RACK FOR STORING TRAYS OR THE LIKE

BACKGROUND OF THE INVENTION

1. Field of the Invention

This invention relates to racks for storing, transporting, or displaying material on trays, pans, or the like.

2. Description of the Prior Art

Racks for carrying or storing trays or pans are commonly used in the food service industry. Food is prepared and placed into pans or onto trays. Racks are used to store the prepared food and to transport the food from the kitchen to the serving area. Soiled dishes, cups and glasses can also be stored on trays and bussed from one area to another.

Such racks are usually designed as large open box-shaped structures about 5 or 6 feet tall, completely open along the front so that the trays can be inserted. A plurality of ledges are provided along the sides onto which the trays are slid. These ledges provide the support for the tray.

Enclosed cabinets have also been used to store or transport material on trays. These cabinets are similar to the racks just described but are fully enclosed on all sides. Such cabinets can be loaded into trucks without the contents spilling. Cabinets are also useful in food catering since the enclosure keeps the food on the trays fresh and at the proper temperature.

Previously, in the construction of such racks or cabinets the ledges were made from a length of sheet metal folded longitudinally at a right angle such that the horizontal surface supplied the ledge while the vertical surface could be attached to the sides of the rack. Each of these ledge pieces was then riveted or welded individually to the rack frame. The attachment of each individual ledge piece was time consuming, expensive, and tedious.

SUMMARY OF THE INVENTION

The present invention provides an improved rack design which eliminates riveting or welding each individual ledge piece to the rack frame. Instead of attaching each individual ledge, slots are provided in the vertical posts of the rack frame. Horizontal support members which comprise the ledges are then inserted into the slots. Only the uppermost and lowermost horizontal support members need be welded or otherwise affixed to the posts. The welding of only the uppermost and lowermost members provides all of the necessary support for the rack frame. The remaining support members are retained in the slots since movement of the posts is restricted by the frame construction.

The rack of the present invention may be built in single units or multiple units. The present invention may be used as an open rack or may be enclosed to form a cabinet. Alternatively, removable side panels may be installed across the sides of the open rack. An alternative embodiment of the present invention provides support members which have dual ledges. The lower ledge supports the tray or storage unit while the upper ledge prevents the tray from tipping over when it is not fully inserted into the rack. Another alternative embodiment uses the same basic rack design to support trays vertically using horizontal posts and perpendicular horizontal support members.

DESCRIPTION OF THE PREFERRED EMBODIMENTS

Figure 1:
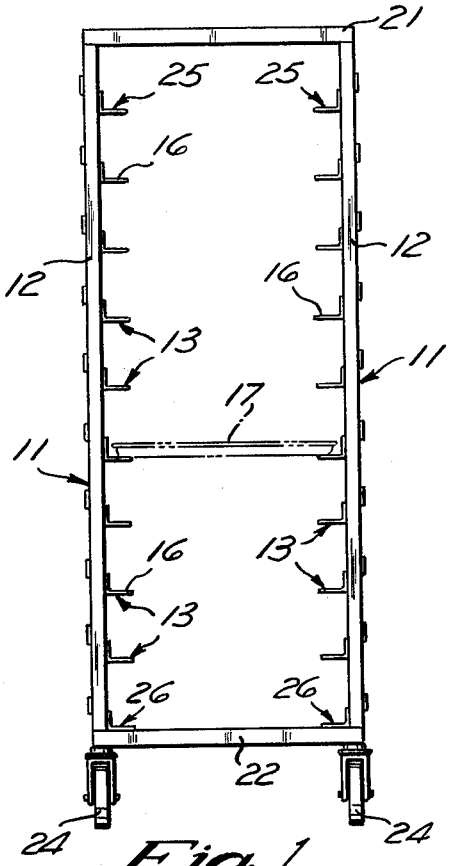
FIG. 1 is a front view of a single unit rack of the present invention.
Figure 2:
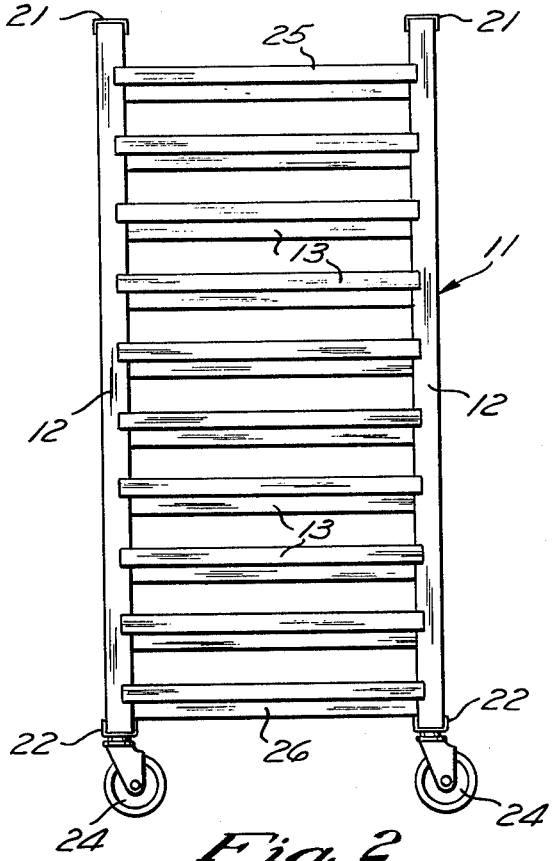
FIG. 2 is a side view of the rack of FIG. 1.
Figure 4:
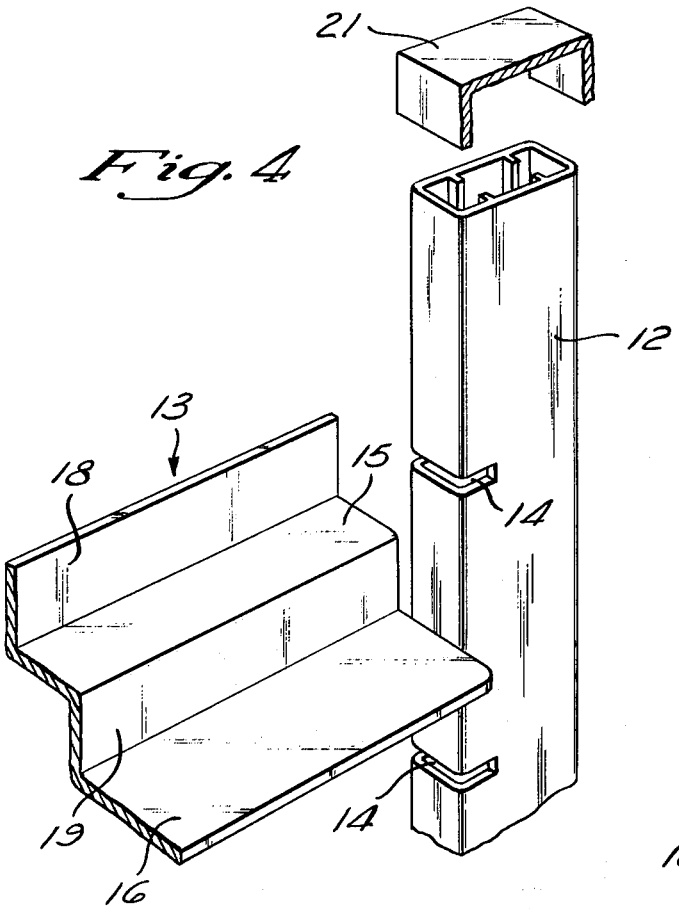
FIG. 4 is an exploded view showing the construction of the rack.

Referring more particularly to the drawings and initially to FIGS. 1 and 2, there is shown a single unit rack in accordance with the present invention. The single unit rack has two side assemblies 11 each of which comprises two identical vertical posts 12 and a plurality of horizontal support members 13. Each post 12 is preferably made from a rectangular tube cut to the proper length; however, channels or I-beam pieces may also be used. The posts are arranged in a parallel fashion with each post defining a corner of the rack frame. The plurality of horizontal support members 13 are interposed along each side of the rack between the two posts of each side assembly as shown in FIG. 2. The support members 13 are supported on the post 12 by a plurality of horizontal slots 14 cut into the posts 12 as shown in FIG. 4. The slots and support members are dimensioned such that the main horizontal surface 15 of the support member 13 fits securely into slot 14. Each support member 13 has a surface ledge 16 which extends into the interior of the rack. This ledge 16 supports a storage unit such as tray 17 shown in FIG. 1. Each support member 13 also has two vertical surfaces 18 and 19. When the support member 13 is fitted into the slot 14, the outer vertical surface 18 fits against the outside vertical surface of post 12 while the inner vertical surface 19 fits securely against the inside vertical surface of post 12. These vertical surfaces aid in communicating the force of the load on the ledge 16 to the post 12.

The rack of the preferred embodiment of the present invention also comprises two upper horizontal braces 21 and two lower horizontal braces 22 to secure and position the side assemblies in the desired parallel relationship. These braces run horizontally and perpendicularly to the support members 13. One upper brace connects the tops of the two front posts while the other upper brace connects the tops of the two back posts. Similarly, one lower brace connects the bottoms of the two front posts, and the other lower brace connects the bottoms of the two back posts. The braces and the posts together define a solid rack frame along the front or back of the rack. Each upper brace 21 fits over the top of a post 12 as shown in FIG. 4, and prevents exposure of the sharp edges where the post was cut. The brace is then fixed to the post as by welding 23 illustrated in FIG. 5. Similarly, the lower brace 22 is fixed under the bottom of post 12. Casters 24 may be added at the base of each post 12 beneath the lower horizontal brace 22 to add portability to the rack.

Figure 5:
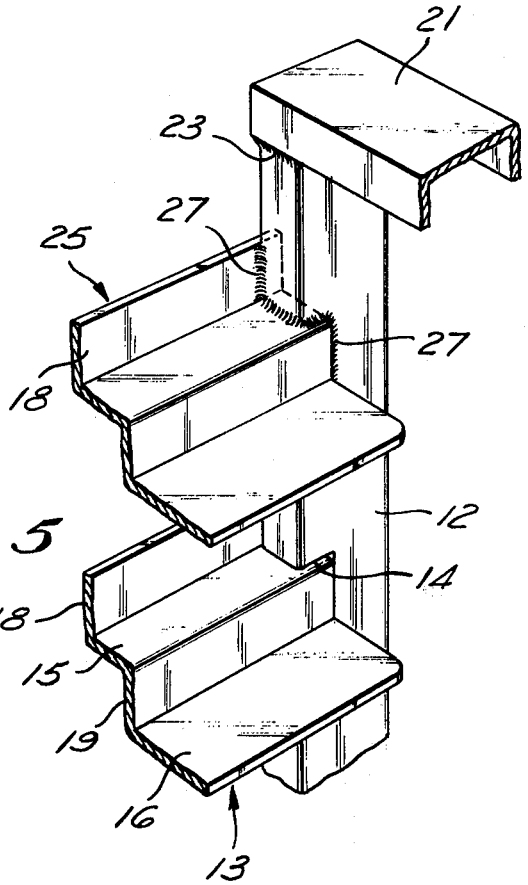
FIG. 5 is a perspective view taken along line 5—5 of FIG. 3.

As shown particularly in FIG. 5, a principal advantage of the rack of the present invention lies in its ease of assembly. Welding, riveting or otherwise affixing each of the support members 13 to post 12 is tedious, time consuming, and expensive. The multiple surfaces of the support member require multiple welds. However, with the present invention only two support members in each side assembly, one near the top and one near the bottom, need to be fixed to the posts. Preferably, the uppermost support member 25 and the lowermost support member 26 are fixed to the posts, such as by welding 27. This welding is necessary to prevent the posts from parting horizontally. Thus, the uppermost and lowermost support members 25 and 26, together with a pair of posts 12 define a solid rack frame along each side of the rack. The remaining support members 13 in each side assembly are supported in the slots 14 without the necessity of welding. Since the frame prevents the posts from horizontally parting, the support members 13 will not become dislodged from the slots 14.

Figure 3:
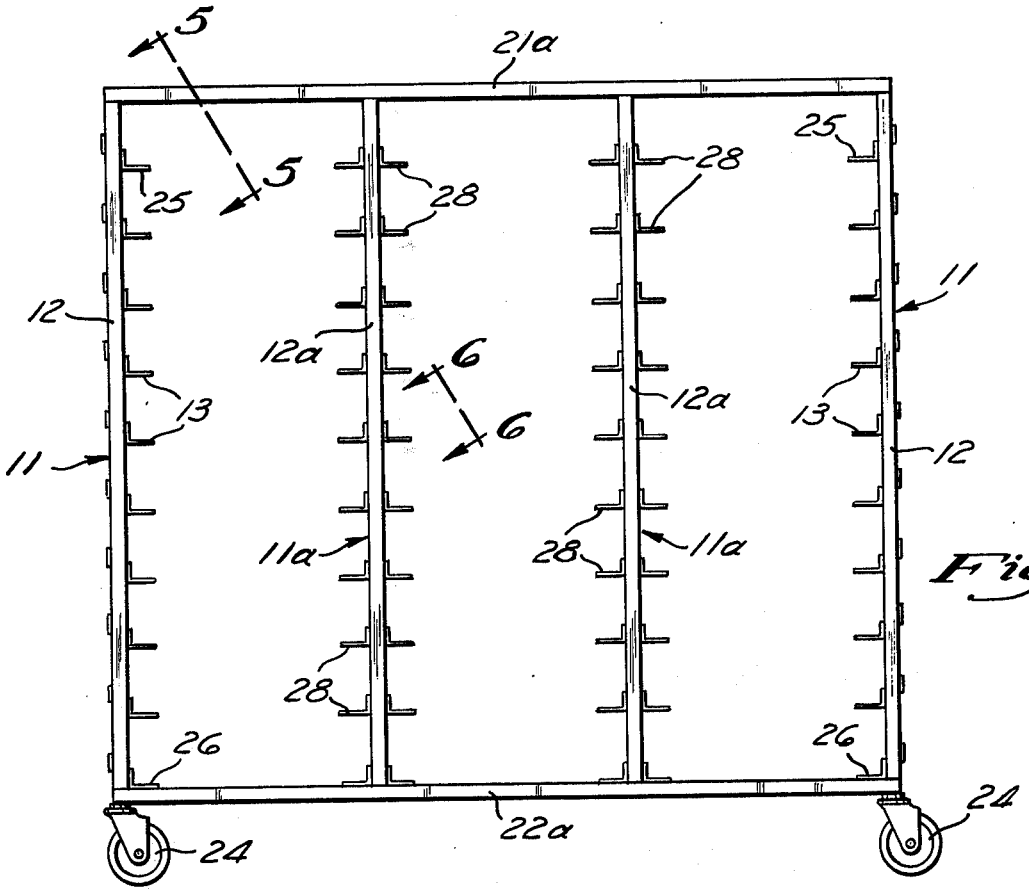
FIG. 3 is a front view of a multiple unit rack of the present invention.
Figure 6:
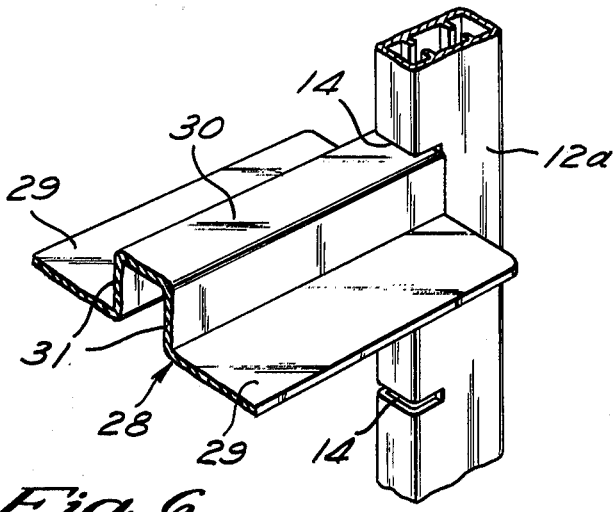
FIG. 6 is a perspective view taken along line 6—6 of FIG. 3.

Another embodiment of the invention is the multiple unit rack of FIG. 3. This embodiment uses the same basic rack construction of the single unit rack with multiple side assemblies 11 and 11*a*, two upper horizontal braces 21*a*, and two lower horizontal braces 22*a*. One upper brace connects together the tops of the front post of each side assembly while the other upper brace connects the tops of the back post of each side assembly. Similarly, one lower brace connects the bottoms of all front posts, and the other lower brace connects the bottoms of all back posts. The outermost side assemblies 11 are identical to those previously described with a plurality of horizontal support members 13 interposed between two vertical posts 12. Similarly, the center side assemblies 11*a* have a plurality of center horizontal support members 28 interposed between two center posts 12*a*. The center posts 12*a* are of identical construction to the outside posts 12 with the same horizontal slots 14, but the center support members 28 are of a slightly different design than support members 13. As shown particularly in FIG. 6, each center support member 28 has two ledges 29 which extend outward in opposite directions. The main horizontal surface 30 fits securely into slot 14 of post 12*a*. The two vertical surfaces 31 fit against the vertical surfaces of post 12*a* and communicate the force exerted on the ledges to the post, similarly as with support member 13. As with the single unit rack, the multiple unit rack can be supported by casters 24.

Another advantage in the construction of the rack of the present invention is in the design of the support members 13 and 28. These support members can be made from sheet metal folded longitudinally into the appropriate proportions. Fabrication of these support members is both easy and economical.

Figure 7:
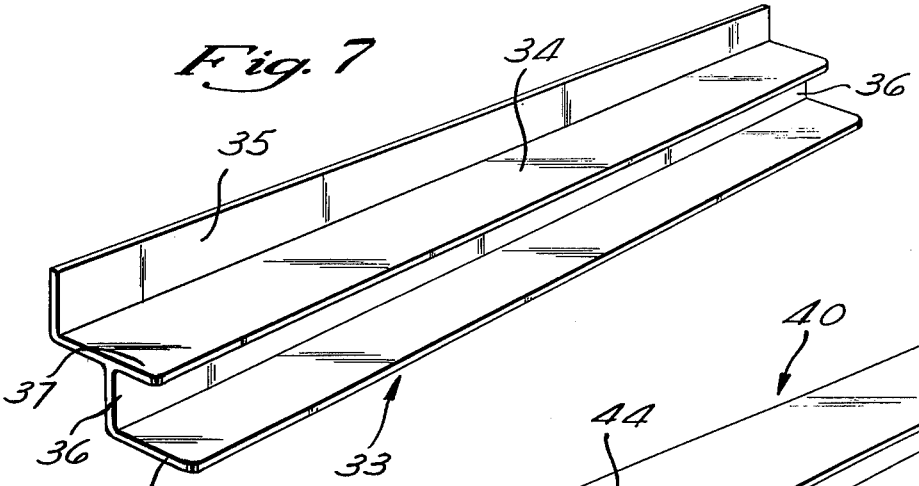
FIG. 7 is a perspective view of an alternative design for the support member.
Figure 8:
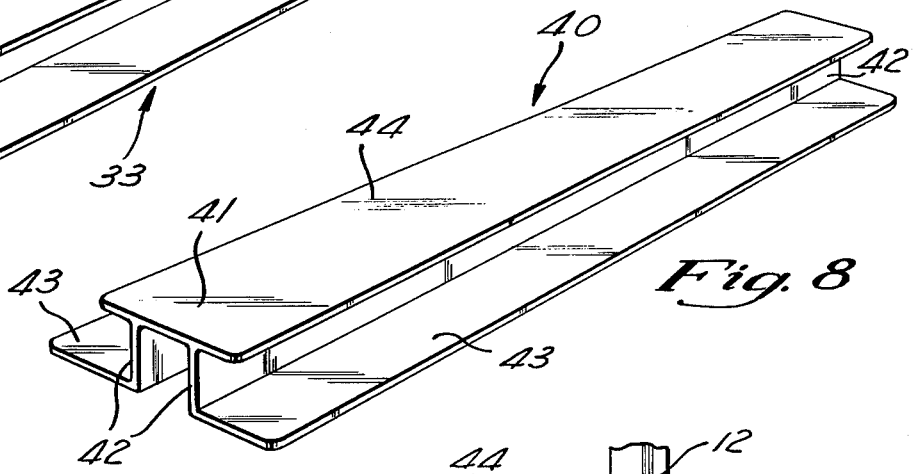
FIG. 8 is a perspective view of an alternative design for the center support member for use in the multiple unit rack.
Figure 9:
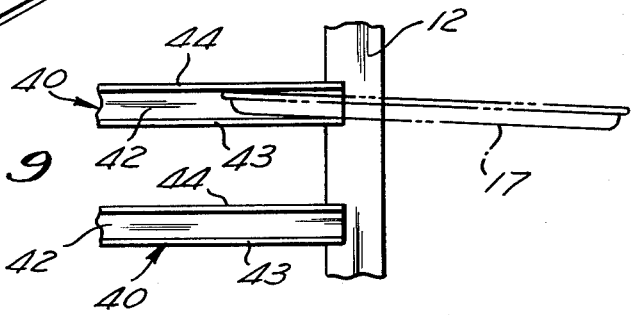
FIG. 9 is a side view of the support member of FIG. 8 showing its use in supporting a tray.

Another embodiment of the present invention uses alternative support members depicted in FIGS. 7, 8 and 9. These support members provide added support to the storage units or trays. The basic support member 33, shown in FIG. 7, is used in single unit racks and on the outside of multiple unit racks. Like support members 13, support member 33 comprises a main horizontal surface 34 which fits into slot 14 of post 12, an outer vertical surface 35 which fits against the outside vertical surface of post 12, and an inner vertical surface 36 which fits against the inside vertical surface of post 12. However, support member 33 differs in construction because it has two parallel ledges. The upper and lower ledges 37 and 38 define a channel into which the tray is slid. Lower ledge 38 supports the tray similarly to ledge 16. Upper ledge 37 is added to restrain the upper surface of the tray when the tray is being slid in or out of the rack. A similar design is provided for center support member 40, depicted in FIG. 8, which is similar in design to center support member 28 for use in the center of multiple rack units. Center support member 40 comprises a main horizontal surface 41 which fits into a slot 14 of post 12*a*, two vertical surfaces 42 which fit against the vertical surfaces of post 12*a* and support the load, a lower ledge 43 for supporting the bottom of the tray, and an upper ledge 44 for restraining the top of the tray. The advantage of the added upper ledge is shown particularly in FIG. 9. As the tray 17 is slid in or out of the rack, the material in the tray may cause the portion of the tray not yet in the rack to lower. This causes the portion of the tray in the rack to rise. The addition of upper ledges such as upper ledge 44 prevents the portion of the tray in the rack from rising and prevents the partially inserted tray from tipping over. Trays may be pulled out beyond halfway without tipping or falling, allowing easy loading or unloading of trays while still on the rack.

The rack frame of the present invention may be used as an open rack, or it may be enclosed in a cabinet. Enclosed cabinets provide a more attractive appearance than an open rack, prevent the contents on the trays from spilling, and allow the contents on the trays to be heated or cooled. A cabinet may be constructed by building an enclosure and inserting into the enclosure the rack frame of the present invention or by attaching panels to the sides, back, top, and bottom of the rack. The panels may be riveted or welded to the posts, and a door may be mounted to the front of the rack. A cooling or heating element may be provided in the cabinet to supply the proper thermal environment for the contents of the trays.

Figure 10:
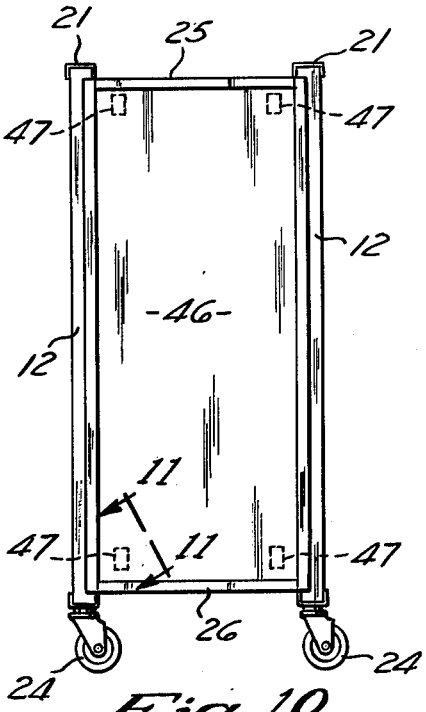
FIG. 10 is a side view of a single unit rack with a removable side panel.
Figure 11:
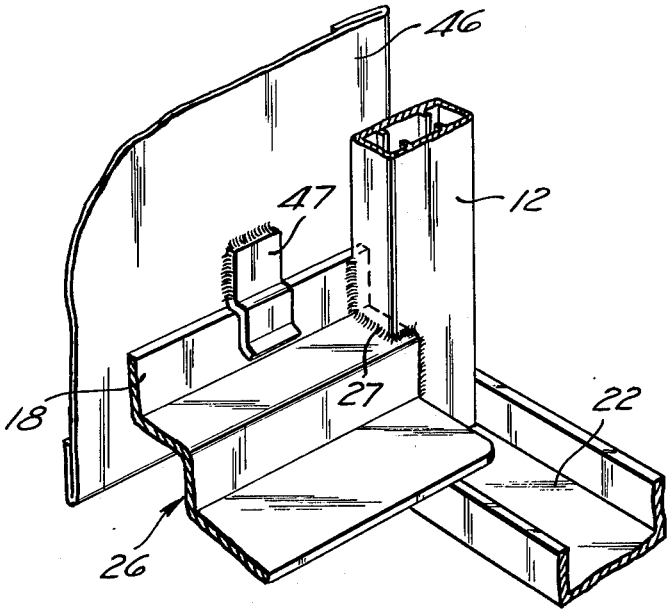
FIG. 11 is a perspective view taken along line 11—11 of FIG. 10.
Figure 12:
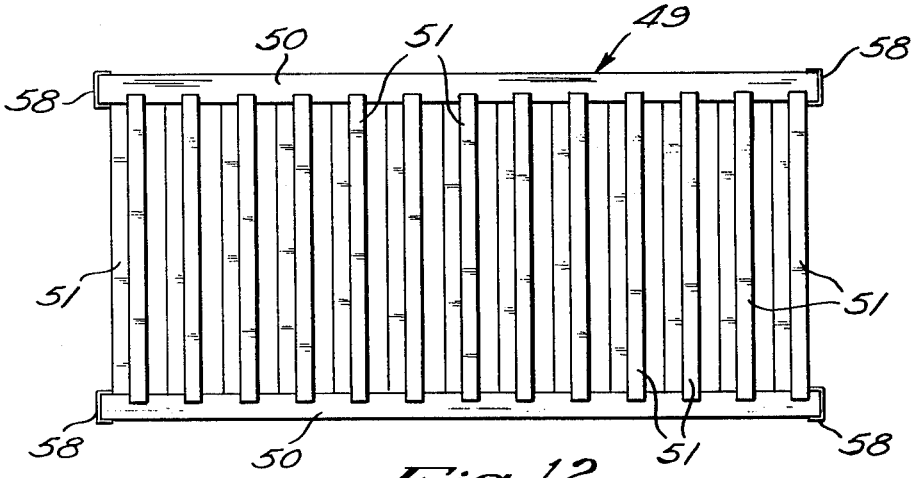
FIG. 12 is a top plan view of a rack for storing trays vertically.
Figure 13:
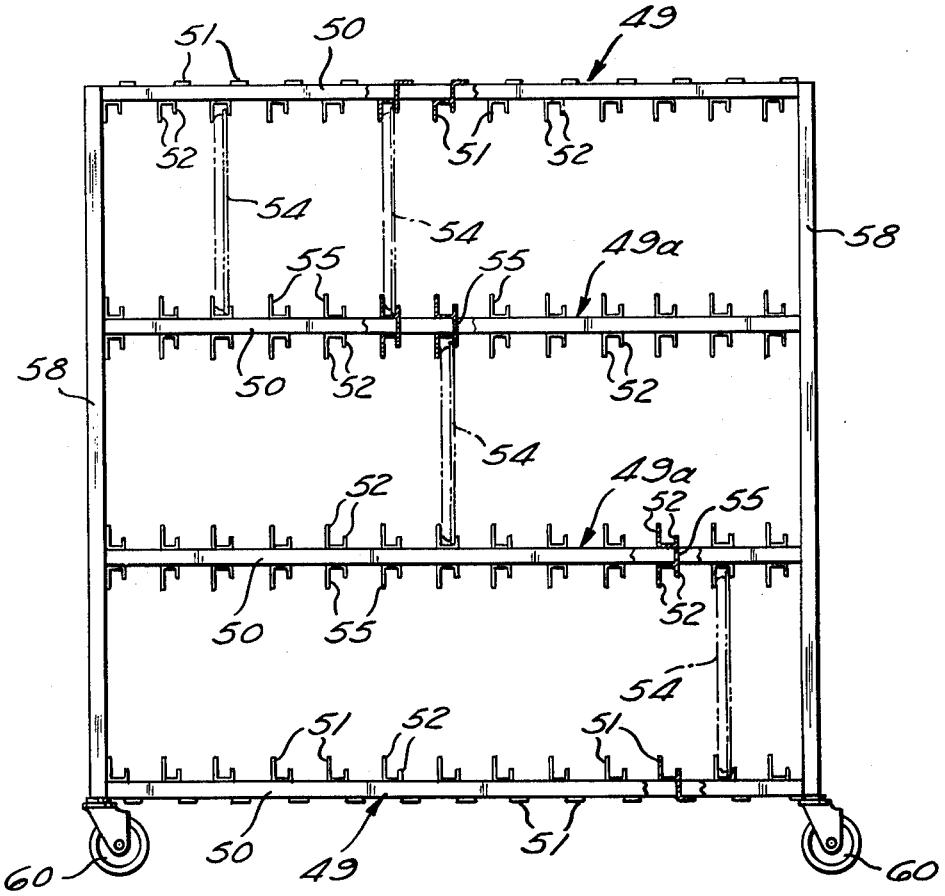
FIG. 13 is a front view of the rack of FIG. 12.

Instead of permanently attached side panels, the rack may have a removable side panel 46 shown in FIGS. 10 and 11. The side panel 46 is supported by several clips 47. As shown particularly in FIG. 11, a clip 47 fits over the outer vertical surface 18 or lowermost support member 26. By this method the side panel 46 is removably secured to the rack. The panel can be removed if desired, simply by lifting the clips off the support members.

In another embodiment of the present invention, trays are supported in a vertical position. The construction of this rack is almost identical to the multiple unit rack with the dual-ledged support members except that the frame is oriented sideways so that the sides become the top and bottom. The rack has several horizontal shelf assemblies 49 and 49*a* which are essentially the same as side assemblies 11 and 11*a*. Each shelf assembly 49 and 49*a* comprises a plurality of horizontal support members interposed between two horizontal posts 50. Each post 50 has a plurality of vertical slots which support the horizontal support members. The top and bottom shelf assemblies 49 have horizontal support members 51 which are of the same design as support member 33 in FIG. 7. Each support member 51 has dual ledges 52 defining a channel into which one edge of a tray 54 can be slid. The middle shelf assemblies 49*a* have horizontal support members 55 which are of the same design as support member 40 in FIG. 8. Each support member 55 has two sets of dual ledges 52 which extend on opposite sides from the post. Only two support members in each shelf assembly 49 and 49*a*, one near each side of the rack, need be welded or otherwise fixed to the post 50. By fixing these two support members, the other support members in the shelf assembly are restrained in the slots.

The shelf assemblies 49 and 49*a* are positioned and secured in the proper horizontal position by means of four vertical braces 58. These vertical braces are attached in the same manner as horizontal braces 21*a* and 22*a*. Casters 60 may also be added to the bottom of each vertical brace.

Using this embodiment, freshly washed trays may be stored vertically and allowed to dry. The dual-ledged support members permit the trays to be spaced apart allowing for free circulation of air between the trays so that the trays will dry quickly. As with the other embodiments, this rack may also be enclosed in a cabinet.

While the invention has been shown and described with respect to specific embodiments thereof, these are intended for the purpose of illustration rather than limitation, and other modifications and variations will be apparent to those skilled in the art all within the intended scope and spirit of the invention. Accordingly, this patent is not to be limited to the specific embodiment herein shown and described nor in any other way which is inconsistent with the extent to which the progress of in the art has been advanced by this invention.

I claim:

1. A rack for storing trays or the like comprising:

a. at least two laterally spaced parallel assemblies each of which comprises 1. two laterally spaced parallel posts having a plurality of longitudinally spaced slots,
2. a plurality of longitudinally extending support members interposed between the posts, each support member having at least three longitudinally extending angularly related surfaces and a ledge for supporting the side of a tray, each end of each support member having only and able to have only endwise entry and withdrawal into and out of a position of retaining engagement with one of the slots with a central one of said angularly related surfaces being received in said slot, and those of said surfaces either side of said central surface having engagement with opposite sides of said post adjacent said slot to prevent rolling of the support member about its length and out of engagement with said posts, one of the support members at each end of the assembly being secured in the slots;

b. means extending between and attached to the assemblies for positioning and securing the assemblies in a parallel spaced relationship.

2. The rack of claim 1 wherein the posts extend vertically and the support members are disposed horizontally.

3. The rack of claim 2 wherein each support member has dual ledges which define a channel into which an edge of the tray is inserted whereby the tray is restrained from tipping.

4. The rack of claim 2 comprising in addition:

c. a side panel having a plurality of clips secured to the panel, each clip being removably attached to one of the support members.

5. The rack of claim 2 wherein each support member has a surface perpendicular to the ledge, a portion of the surface fitting against one of the posts whereby any load on the ledge is communicated to the post.

6. The rack of claim 1 wherein the posts extend horizontally and the support members are disposed horizontally and perpendicularly to the posts.

* * * * *